US006399862B1

(12) United States Patent
Wilfer

(10) Patent No.: US 6,399,862 B1
(45) Date of Patent: Jun. 4, 2002

(54) NECK FOR A STRINGED INSTRUMENT

(76) Inventor: Hans-Peter Wilfer, Zum Hackerhof 5, D-08258 Markneukirchen (DE)

( * ) Notice: Subject to any disclaimer, the term of this patent is extended or adjusted under 35 U.S.C. 154(b) by 0 days.

(21) Appl. No.: 09/728,289

(22) Filed: Dec. 1, 2000

(30) Foreign Application Priority Data

Nov. 1, 2000 (EP) ..... 00 122 806.3

(51) Int. Cl.[7] ..... G10D 3/00
(52) U.S. Cl. ..... 84/293; 84/291; 84/297 R
(58) Field of Search ..... 84/293, 291, 297 R

(56) References Cited

U.S. PATENT DOCUMENTS

| | | | | |
|---|---|---|---|---|
| 3,143,028 A | | 8/1964 | Fender | |
| 4,172,405 A | * | 10/1979 | Kaman, II | 84/293 |
| 4,528,886 A | * | 7/1985 | Fender | 84/293 |
| 4,557,174 A | * | 12/1985 | Gressett, Jr. | 84/293 |
| 4,852,449 A | * | 8/1989 | Zeitler | 84/293 |
| 5,233,122 A | * | 8/1993 | Kim | 84/293 |
| 5,251,526 A | | 10/1993 | Hill | |
| 5,696,334 A | * | 12/1997 | Terry | 84/293 |
| 6,051,765 A | * | 4/2000 | Regenberg et al. | 84/293 |
| 6,051,766 A | | 4/2000 | Taylor | |
| 6,100,458 A | * | 8/2000 | Carrington et al. | 84/293 |

FOREIGN PATENT DOCUMENTS

GB 1043201 3/1996

* cited by examiner

*Primary Examiner*—Robert E. Nappi
*Assistant Examiner*—Kim Lockett
(74) *Attorney, Agent, or Firm*—Sidley Austin Brown & Wood, LLP

(57) ABSTRACT

A neck for a stringed instrument and including a neck body, a fingerboard, and an adjusting device located in a groove provided between the neck body and the fingerboard for adjusting the neck curvature, with the adjusting device including a bar secured in two, spaced from each other anchoring points provided on or in the neck and capable of absorbing tensioning or compression forces applied by the bar upon changing of its operational length, and a curve element for holding the bar in a desired curved position and for changing the bar operational length.

10 Claims, 2 Drawing Sheets

NECK FOR A STRINGED INSTRUMENT

BACKGROUND OF THE INVENTION

1. Field of the Invention

The present invention relates to a neck for a stringed instrument such as, e.g., a guitar or a bass-guitar and including a neck body, a fingerboard having a playing surface located adjacent to the strings, and an adjusting device located in a groove provided between the neck body and the fingerboard for adjusting the neck curvature.

2. Description of the Prior Art

An adjusting device of a type described above is disclosed in the prior European patent EP 273 372B1 of the applicant. However, it was shown that the adjusting device, which was disclosed in the above-mentioned European patent, needed improvement. The known adjusting device includes two, extending parallel to each other, bars connected at one of their ends and capable of being offset relative to each other at the other of their ends, so that the bars themselves can provide for changing the curvature of the string instrument such as guitar or bass-guitar. For the bars, comparatively large recesses need be formed in the neck which leads to weakening of the neck. Moreover, the double-bar system applies an excessive load to the neck.

Because of the foregoing drawbacks, the known adjusting device did not find wide acceptance. In accordance with one of the embodiment of the known device, only one bar is placed in the groove and is fixed at the resonance box-side anchoring point, with the end of the bar remote from the resonance box being freely arranged. The bar is held in its curved position with a curve wedge. At the free end of the wedge, there may be provided a nut which lies on the neck and which can be tightened to "straighten" the bar. The object of tightening the nut was to curve the neck to the back against tensioning forces applied by the strings.

Generally, the known adjusting device should have provided the most advantageous curvature of the neck which can be corrected even after the neck has been formed and after an extensive use with different strings.

Accordingly, an object of the invention is to provide a neck for a stringed instrument, in particular a guitar or bass-guitar in which the curvature of the neck can be adjusted in a simple and precise manner after the neck has been formed and after an extensive use.

SUMMARY OF THE INVENTION

This and other objects of the present invention, which will become apparent hereinafter, are achieved by providing adjusting means including a bar secured in two, spaced from each other anchoring points provided on or in the neck and capable of absorbing tensioning or compression forces applied by the bar upon changing of its operational length, and including curve means for holding the bar in a desired curved position and for changing the operational length of the bar.

The present invention is applicable to all stringed instruments. In addition to guitars and bass-guitars, the present invention can be used in cellos, violins, double basses, concert and western guitars, banjos, etc.

The basic idea of the present invention consists in that the bar placed in the neck of a stringed instrument can transmit not only tensioning forces but also compression forces, so that the tensioning force of the strings not only can be reduced and compensated but also can be reinforced. During manufacturing, a certain curvature or reverse tensioning of the neck is provided and which, on one hand, is necessary for providing free space for oscillation of the strings with respect to the playing surface of the fingerboard and, on the other hand, prevents the strings form applying a not insignificant force which would curve the neck dependent on the strength and tensioning of the strings.

The adjusting nut according to the present invention permits to undertake correction in both directions, i.e., the effect of the tensioning force of the strings can be reinforced, reduced or compensated. A pure compensation of the string pull provides for preadjustment of the outwardly curvature in the opposite direction.

The adjusting nut according to the present invention permits to compensate manufacturing tolerances, effect of using different strings, and the change of the curvature with time.

The proposed adjusting means can be easily realized. The means according to the present invention hardly weakens the neck of a guitar or bass-guitar, rather, it reinforces the neck.

The effectiveness of the proposed adjusting means can be predetermined within certain limits by presetting the curvature radius of the groove and the radius of the curve wedge. A too flat curvature radius of the groove or the curve wedge would limit the action of the adjusting means. A too large curvature cannot be realized due to the limited material strength of the neck body and because of a limited elasticity of wood which primarily but not exclusively is used for producing the necks of stringed instruments. However, the possible, based on the neck body geometry, curvature radii of the groove or the curve wedge are adequate for achieving a desired effect.

In accordance with a common embodiment of the present invention, the curve means can be arbitrary formed. E.g., a plurality of spacers can be provided between the fingerboard and the bar. The main thing is to keep the bar in its curved position. In accordance with a preferred embodiment of the present invention, the curve means is formed as a curve wedge located between the fingerboard and the bar. In accordance with a particularly advantageous embodiment of the present invention, the curve wedge is formed of a wood piece.

The present invention is primarily based on using tensile and compression characteristic a curved tensile and compression bar. In accordance with an advantageous embodiment of the present invention, a bar, which is curved in a direction away from the playing surface of the fingerboard, is used. Theoretically, a curvature change of the curve bar in both directions, i.e., also in the direction toward the playing surface of the fingerboard, is possible. However, from the manufacturing point of view, it is very difficult to produce such a bar.

In accordance with a further advantageous embodiment of the invention the bar has at its nut-side a thread portion, and the curve means further comprises an adjusting nut screwed on the bar thread portion and fixable in the nut-side anchoring point. Here, "nut-side" means in the vicinity of the free end of the neck body at which a head may or may not be arranged (in the later case, the neck is "headless"). This embodiments differs from the prior art in that the adjusting nut is fixedly secured in the anchoring point both in the tensioning and compression directions. Thereby, both compression and tensile forces can be applied to the bar.

In the resonance box-side anchoring point, the bar is fixed against both the tensile force and the compression force. Nonetheless, with corresponding expenses, means for changing the operational length of the bar, in order to achieve the same object of changing the neck curvature in both directions, can be also provided at the resonance box-side anchoring point. For completeness sake, it should be noted that the resonance box-side anchoring point can lie outside the neck, in the region of the resonance box. However, this would make the separation between the neck and the resonance box more difficult.

In a particularly preferred embodiment of the present invention, the adjusting nut is provide in its outer surface with a groove for receiving anchoring means which keeps the adjusting nut in the nut-side anchoring point, preventing it from displacement under actions of tensile and compression forces acting on the bar. However, the adjusting nut can be fixed and held in the anchoring point against tensile and compression forces by other means or in another way. However, providing anchoring means engageable in a circumferential groove provided in the adjusting nut outer surface permits to reliably hold the adjusting nut in a desired position and insures an easy access to the nut necessary for effecting the adjustment.

A particularly convenient actuation of the adjusting nut is insured when an adjusting channel is formed in the peg head adjoining the neck. It is known to provide an adjusting nuts which are used for adjusting only the action of the tensile forces. The provision of the adjusting channel in inventive means insures a convenient actuation of the adjusting nut for changing curvature parameter when both tensile and compression forces act on the bar.

Though, as discussed above, shortening or lengthening of the operational length of the bar is also possible at the resonance box-side anchoring point, it is preferred when the bar is fixed in this point.

According to a further aspect of the present invention, the bending of the neck is influenced by providing, in the resonance box-side region of the neck, reinforcing elements that provide for bending of the neck primarily in its nut-side region. This permits to provide a curvature corresponding to the oscillation characteristics of the strings. Because the fingerboard of the neck essentially retraces the amplitude characteristics of the string oscillation, it is insured that the oscillating strings are not struck, on one hand, and, on the other hand, are spaced from the fingerboard at a substantially same distance.

In accordance with an advantageous embodiment of the present invention the reinforcing elements are formed as steel inserts located in grooves provided in the neck body. They are secured in their grooves upon securing of the fingerboard to the neck.

In order to achieve the most favorable reinforcing effect, the steel inserts are so placed in their grooves that their preferential plane in the neck longitudinal direction extends transverse to the playing surface of the fingerboard. In this direction, the reinforcing of the neck against the action of the tensile forces applied by the strings is particularly effective. The curvature profile of the neck can be modified by appropriately dimensioning the thickness and length of the steel inserts.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
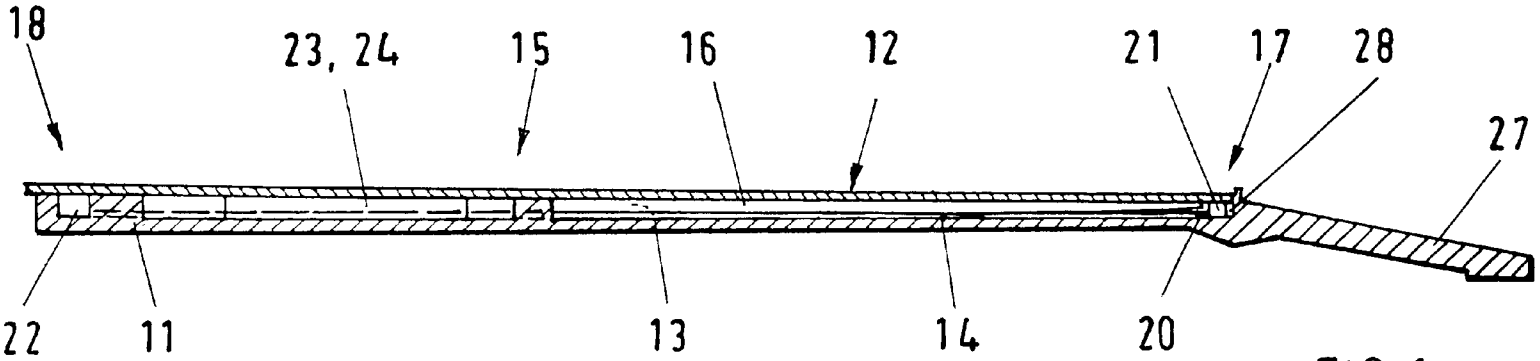
FIG. 1 a longitudinal cross-sectional view of a neck of a guitar.
Figure 2:
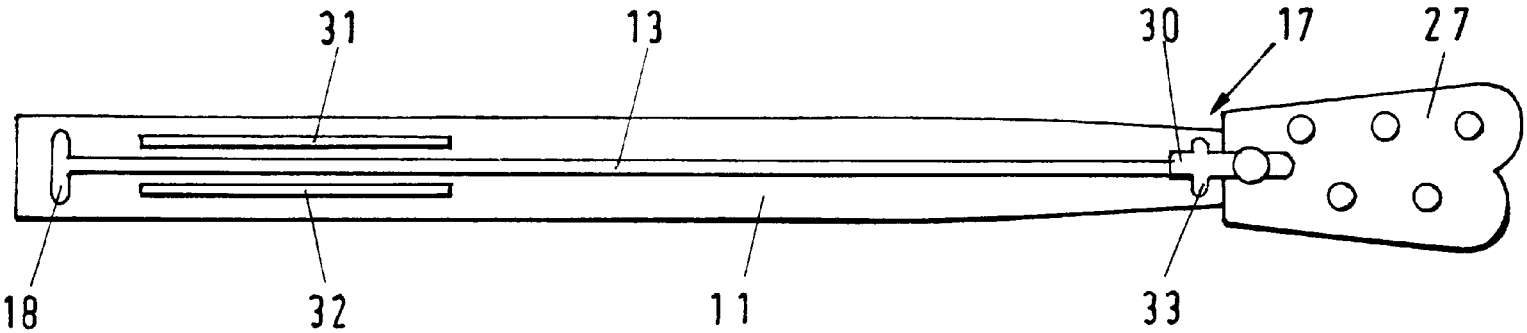
FIG. 2 a plan view of a neck of the guitar shown in FIG. 1.
Figure 3:
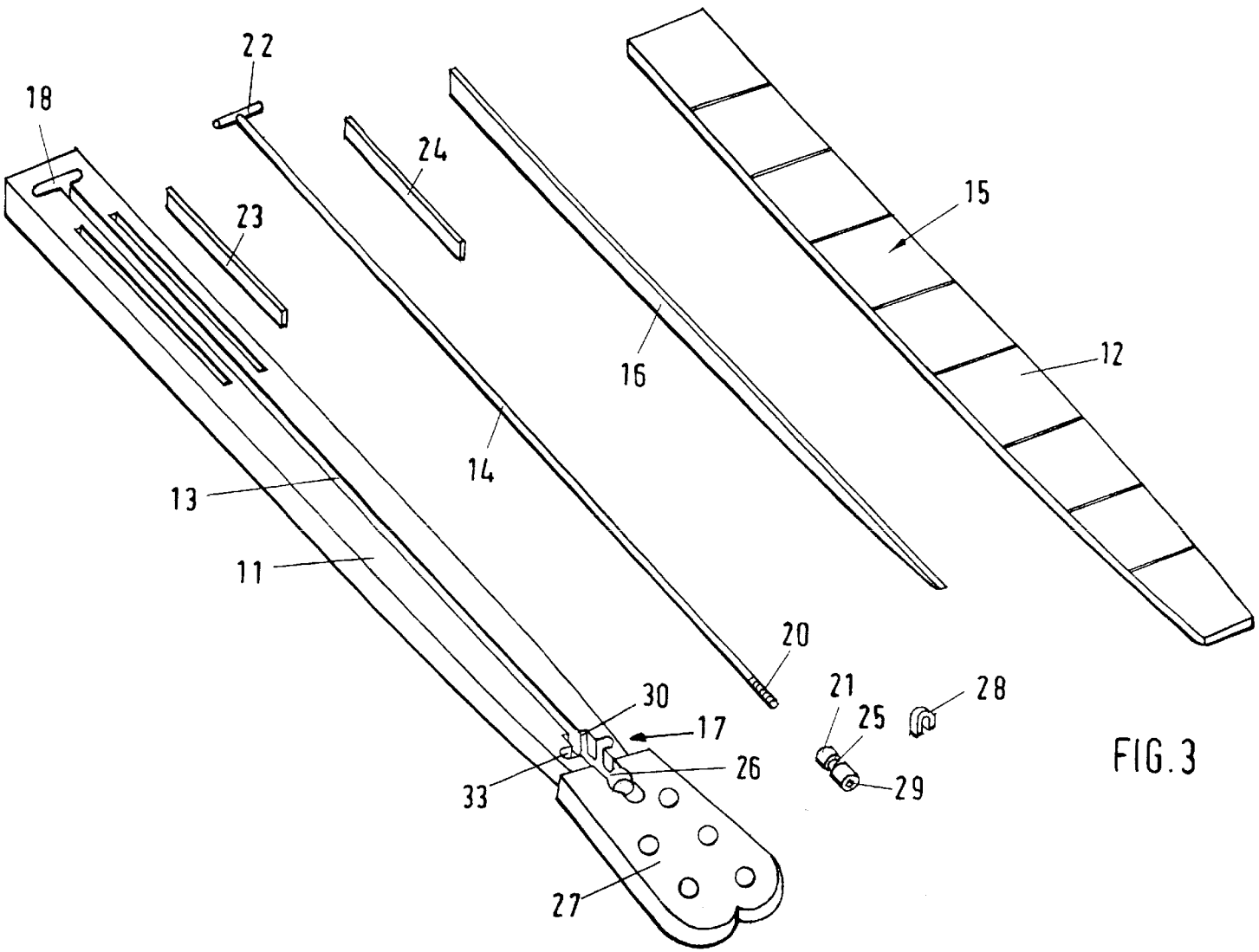
FIG. 3 a perspective exploded view of the guitar neck according to the present invention and shown in FIGS. 1–2.

A neck for a stringed instrument, such as guitar or bass-guitar, according to the present invention, which is shown in FIGS. 1–3, has a neck body 11 at one end of which, there is provided a peg head 27 in which a mechanism for tuning of the strings is arranged. At its side adjacent to the strings, the neck body 11 has a groove 13 which, e.g., can be milled in the body 11. The groove 13 extends substantially over the entire length of the neck. The depth of the groove 13, with respect to the outer, adjacent to the strings, surface of the neck body 11, constantly increases starting from resonance box-side end of the neck body 11 where it has a certain depth, toward the middle region where a maximum depth is reached. From the middle region, the depth of the groove 13 continuously decreases toward the head 27. The groove 13 is limited, on its opposite ends by anchoring points 17, 18 for a bar 14 which would be described further below.

The bar 14 is placed in the groove 13. At its end, remote from the head 27, the bar 14 carries an anchoring element or member 22 which extends transverse to the bar 14. The anchoring member 22 is placed in a complementary recess which defines a resonance box-side anchoring point 18.

At its opposite, nut end, the bar 14 has an outer thread 20. An adjusting nut 21 is screwed onto the tread 20. The adjusting nut 21 is located in a recess 30 the shape of which corresponds to that of the adjusting nut 21 and which adjoins the groove 13. The adjusting nut 21 surrounds the nut-side end of the bar 14 in a sleeve-like manner and is provided at its front end with a hexagon socket 29 or any other suitable actuation means that insures its actuation with a suitable tool for displacement the adjusting nut 21 with respect to the end of the bar 14. To this end, an adjusting channel 26 is provided in the head 27.

A circumferential groove 25 is provided in the outer circumferential surface of the adjusting nut 21. Nut-side anchoring means, which is formed as a clip 28 in the embodiment shown in the drawings, engages in the groove 25. The clip 28 is held in the nut-side anchoring point 17 and is fixed in tensioning and compression directions of the bar 14. The anchoring point 17 is defined by a widening 33 of the recess 30 from the adjusting nut 21.

A curve wedge 16, which as curve means should hold the bar 14 in a curved position, is placed onto the bar 14 located in the groove 13. The curve wedge 16 is formed of a wood piece the thickness of which increases from a certain minimum thickness to a maximum to the middle of the wedge and then again decreases. The curved profile of the curve wedge 16 corresponds, in the embodiment shown in the drawings, substantially to the depth profile of the groove 13 so that when the fingerboard 12 is placed on the surface of the neck body 11, the curve wedge 16 substantially fills the space of the groove 13 that remains between the bar 14 and the fingerboard 12. The bar 14 is pressed against the bottom of the groove 13 and is loosely located there.

Plate-shaped steel inserts 23, 24, which serve as reinforcing members, are provided in the resonance box-side region of the neck body for reinforcing the neck. The preferential plane of the steel inserts 23, 24 extends transverse to the fingerboard and parallel to the neck. The curvature of the neck can be preadjusted, upon changing the operational length of the bar 14, by varying the length, thickness, position, shape, and number of steel inserts.

FIG. 2, as discussed above, shows a plan view of the neck body 11 and of the adjoining the neck body, peg head 27. The groove 13, which extends in the middle of the neck body 11, is clearly visible. The groove 13 is limited, as discussed above, by the resonance box-side and nut-side anchoring points 18, 17, respectively. A groove 30 for the adjusting nut 21 is provided at the nut side anchoring point 17. The groove 30, as again was discussed above, has a widening 33 for the clip 28.

Parallel to the groove 13, there are provided grooves 31, 32 for the steel inserts 23, 24. The fixation of the inserts 23, 24 in the grooves 31, 32 is effected by adapting the shape and size of the grooves 31, 32 to those of inserts 23, 24 so that the grooves 31, 32 become completely covered by the fingerboard 12.

FIG. 3 shows an exploded view of the neck for a guitar or bass-guitar shown in FIG. 1. FIG. 3 shows perspective views of the all of the elements of the neck, the neck body 11, the fingerboard 12, the adjusting nut 21. The fingerboard 12 has a playing surface 15 over which strings (not shown) extend.

The functioning of the adjusting nut 21 should be clear from FIGS. 1–3. The adjusting nut 21, in particular together with the bar 14 which operates in tensioning and compressing direction and which cooperate with the curve wedge 16, permit to adjust the curvature of the neck body 11. If the neck is curved too strong in the tensioning direction of the strings, the shortening of the operational length of the bar 14 between the resonance box-side anchoring point 18 and the nut-side anchoring point 17 reduces the curvature of the neck body 11 and transmits the pressure forces acting substantially transverse to the fingerboard 12 to the curve wedge 16. The pressure forces are particularly large in the middle region of the wedge 16 so that the preliminarily concave curvature of the fingerboard 12 and/or its concave curvature caused by tensioning of the strings can be reduced. The curve wedge 16 acts on the fingerboard curve from beneath, flattening same.

There exist conditions when the fingerboard predetermined and/or caused by the tensioned string, curvature is not sufficiently large. In this case, the adjusting nut 21 can be used for increasing the curvature. The adjusting nut 21 is used for increasing the operational length of the bar 14 between the resonance box-side anchoring point 18 and the nut-side anchoring point 17. The adjusting nut 21 is fixed at the nut-side anchoring point 17 in the tensioning or compressing direction of the bar 14 by the clip 28 held in the widening 33 of the groove 30.

The increase of the operational length of the bar 14 results in an increased curvature. The bar 14 projects, in its middle region, from the groove 13, with the neck body 11 following the course of the curvature of the bar 14. The neck body 11 becomes curved upward from the plane of the strings, providing the desired effect.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A neck for a stringed instrument, comprising a neck body; a fingerboard having a playing surface located adjacent to the strings; and adjusting means located in a groove provided between the neck body and the fingerboard for adjusting the neck curvature, the adjusting means including a bar having a changeable operational length and being secured in two, spaced from each other, anchoring points provided on or in the neck and capable of absorbing tensioning or compression forces applied by the bar upon changing of the operational length thereof, and curve means for holding the bar in a curved position, wherein the adjusting means are capable of either diminishing, compensating or increasing the neck curvature caused by the tensioning forces of the strings, wherein the bar has, at a nut-side thereof, a thread portion, wherein the curve means further comprises an adjusting nut screwed on the bar thread portion and located in the nut-side anchoring point, and means for fixing the adjusting nut in the nut-side anchoring point against the tensioning or compression forces applied by the bar, and wherein the neck includes a peg head having an adjusting channel for actuating the adjusting nut.

2. A neck as set forth in claim 1, wherein the adjusting nut has a groove formed in an outer surface thereof for receiving the fixing means.

3. A neck for a stringed instrument, comprising a neck body; a fingerboard having a playing surface located adjacent to the strings; and adjusting means located in a groove provided between the neck body and the fingerboard for adjusting the neck curvature, the adjusting means including a bar having a changeable operational length and being secured in two, spaced from each other, anchoring points provided on or in the neck and capable of absorbing tensioning or compression forces applied by the bar upon the changing of the operational length thereof, and curve means for holding the bar in a curved position, wherein the adjusting means are capable of either diminishing, compensating or increasing the neck curvature caused by the tensioning forces of the strings, wherein the curve means is held in a concave position with respect to the playing surface of the fingerboard.

4. A neck for a stringed instrument, comprising a neck body; a fingerboard having a playing surface located adjacent to the strings; and adjusting means located in a groove provided between the neck body and the fingerboard for adjusting the neck curvature, the adjusting means including a bar having a changeable operational length and being secured in two, spaced from each other, fixed anchoring points provided on or in the neck for absorbing tensioning or compression forces applied by the bar upon changing of the operational length thereof, and curve means for holding the bar in a curved position, wherein the adjusting means are capable of either diminishing, compensating or increasing the neck curvature caused by the tensioning forces of the strings.

5. A neck as set forth in claim 4, wherein the curve means comprises a curve wedge loosely arranged in the groove between the bar and the fingerboard.

6. A neck as set forth in claim 5, wherein the curve wedge is formed of a wood piece.

7. A neck as set forth in claim 4, wherein the bar is provided, at a resonance box-side end thereof, with an anchoring member extending transverse to a longitudinal extent of the bar and secured in the resonance box-side anchoring point.

8. A neck as set forth in claim 4, wherein the neck has, in a resonance box-side region thereof reinforcing means which provide for curving of the neck substantially in a nut-side region of the neck.

9. A neck as set forth in claim 8, wherein the reinforcing means comprises plate-shaped steel inserts.

10. A neck as set forth in claim 9, wherein a preferential plane of the steel inserts, which extends in a longitudinal direction of the neck, is arranged transverse to the playing surface of the fingerboard.

* * * * *